US012096889B2

(12) United States Patent
Tramontina

(10) Patent No.: US 12,096,889 B2
(45) Date of Patent: Sep. 24, 2024

(54) DISPENSER MANUAL FEED DETECTION SYSTEM

(71) Applicant: Kimberly-Clark Worldwide, Inc., Neenah, WI (US)

(72) Inventor: Paul F. Tramontina, Harleysville, PA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 438 days.

(21) Appl. No.: 17/418,495

(22) PCT Filed: Dec. 17, 2019

(86) PCT No.: PCT/US2019/066829
§ 371 (c)(1),
(2) Date: Jun. 25, 2021

(87) PCT Pub. No.: WO2020/142202
PCT Pub. Date: Jul. 9, 2020

(65) Prior Publication Data

US 2022/0079395 A1 Mar. 17, 2022

Related U.S. Application Data

(60) Provisional application No. 62/787,214, filed on Dec. 31, 2018.

(51) Int. Cl.
*A47K 10/36* (2006.01)
*A47K 10/38* (2006.01)

(52) U.S. Cl.
CPC ..... *A47K 10/3631* (2013.01); *A47K 10/3656* (2013.01); *A47K 10/38* (2013.01)

(58) Field of Classification Search
CPC ..... A47K 10/38; A47K 10/3631; A47K 10/3637; A47K 10/3643; A47K 10/3656; A47K 2010/3266
See application file for complete search history.

(56) References Cited

U.S. PATENT DOCUMENTS 6,360,181 B1 * 3/2002 Gemmell ..... G07F 9/002 702/128
7,370,824 B1 5/2008 Osborne
(Continued)

FOREIGN PATENT DOCUMENTS

CN 101557737 A 10/2009
WO 2010083380 A1 7/2010
(Continued)

OTHER PUBLICATIONS

Haggman, Elisabeth et al., "Paper Towel Dispenser for High Traffic Washrooms", Department of Design Sciences, http://lup.lub.lu.se/luur/download?func=downloadFile&recordOld=1317046&fileOld=1887877.

(Continued)

*Primary Examiner* — Gene O Crawford
*Assistant Examiner* — Kelvin L Randall, Jr.

(57) ABSTRACT

A dispenser comprising a body comprising a front side and a back side, and a product holding area defined by the front side and the back side, wherein the product holding area is configured to store the consumable product within the dispenser; a dispensing mechanism operatively coupled to the consumable product, and wherein the dispensing mechanism is configured to facilitate a dispensing cycle to dispense a portion of the consumable product in response to a user pulling on an exposed portion of the consumable product; a product advancement device coupled to the dispensing mechanism and accessible external to the body, and wherein the product advancement device is configured to allow a user to manually actuate the dispensing mechanism; a product advancement sensor configured to sense the manual actuation; and a data processing device configured to communicate with the product advancement sensor and transmit an alert indicating the manual actuation.

13 Claims, 3 Drawing Sheets

(56) References Cited

U.S. PATENT DOCUMENTS

| | | | | |
|---|---|---|---|---|
| 7,774,096 | B2 | 8/2010 | Goerg et al. | |
| 7,832,679 | B2 | 11/2010 | Denen et al. | |
| 8,395,396 | B2 * | 3/2013 | Hagleitner | A47K 5/1217 73/862.626 |
| 9,370,283 | B2 | 6/2016 | Fellhoelter | |
| 9,604,811 | B2 | 3/2017 | Case et al. | |
| 2009/0140001 | A1 | 6/2009 | Lewis et al. | |
| 2012/0167739 | A1 * | 7/2012 | Lewis | B26D 5/00 83/663 |
| 2012/0312853 | A1 | 12/2012 | Osborne et al. | |
| 2014/0210620 | A1 | 7/2014 | Snodgrass | |
| 2014/0367401 | A1 | 12/2014 | Strålin et al. | |
| 2015/0035678 | A1 | 2/2015 | Long | |
| 2015/0066207 | A1 | 3/2015 | Erb | |
| 2015/0157177 | A1 | 6/2015 | Carper et al. | |
| 2017/0057775 | A1 | 3/2017 | Kobs et al. | |
| 2018/0310780 | A1 | 11/2018 | Mahaffey et al. | |
| 2019/0082898 | A1 | 3/2019 | Ghazi et al. | |

FOREIGN PATENT DOCUMENTS

| | | | |
|---|---|---|---|
| WO | 2014028808 | A1 | 2/2014 |
| WO | 2017032697 | A1 | 3/2017 |
| WO | 2017105464 | A1 | 6/2017 |
| WO | 2018170219 | A1 | 9/2018 |

OTHER PUBLICATIONS

MOPEC, "User Manual MB800 Grossing Station", MOPEC User Manual, https://www.mopec.com/wp-content/uploads/2016/06/MB800-Manual-2016-Rev-B.pdf.

* cited by examiner

DISPENSER MANUAL FEED DETECTION SYSTEM

This application claims priority from U.S. provisional Patent Application Ser. No. 62/787,214 filed on 31 Dec. 2018, the entire contents of which are incorporated herein by reference.

TECHNICAL FIELD

This disclosure generally relates to dispensers for dispensing consumable products.

BACKGROUND OF THE DISCLOSURE

There are multiple types of dispensers for dispensing hygienic consumable products including, for example, paper towels and bath tissue. One such type of dispenser is a manual "sanitary" or "no-touch" dispenser. These types of manual dispensers allow a user to obtain a sheet of the consumable product by pulling a partially exposed sheet hanging from the dispenser, which causes both dispensing and cutting of the sheet. As such, these "sanitary" or "no-touch" dispensers allow a user to cause a sheet to be dispensed, in normal operation, without contacting the (body of the) dispenser.

On occasion a sheet may not properly dispense. For example, a user may pull on the exposed tail of the sheet only to have the sheet "tab" when the sheet prematurely or incompletely rips without fully dispensing. In these instances, many manual dispensers include a lever, push bar or rotatable knob or wheel that a user can actuate to complete the dispensing process. As such, use of the lever, push bar, knob or wheel in these types of "sanitary" or "no-touch" dispensers may be indicative of problems with the consumable product or dispenser malfunctions. Therefore it would be beneficial for a service attendant for the dispenser to have knowledge of a user having to resort to use of the emergency manual feed device (e.g., lever, push bar, knob or wheel) so that the attendant could proactively visit and service the dispenser to avoid or minimize any dispenser malfunctions or address any consumable product deficiencies.

SUMMARY OF THE DISCLOSURE

In general, the subject matter of this specification relates to a dispenser, e.g., a consumable product dispenser. One aspect of the subject matter described in this specification can be implemented in a dispenser comprising a body comprising a front side and a back side, and a product holding area defined by the front side and the back side, wherein the product holding area is configured to store the consumable product within the dispenser; a dispensing mechanism operatively coupled to the consumable product, and wherein the dispensing mechanism is configured to facilitate a dispensing cycle to dispense a portion of the consumable product in response to a user pulling on an exposed portion of the consumable product; a product advancement device coupled to the dispensing mechanism and accessible external to the body, and wherein the product advancement device is configured to allow a user to manually actuate the dispensing mechanism; a product advancement sensor configured to sense the manual actuation; and a data processing device configured to communicate with the product advancement sensor and transmit an alert indicating the manual actuation. Other embodiments of this aspect include corresponding methods and apparatus.

Another aspect of the subject matter described in this specification can be implemented in a method that includes detecting, by a product advancement sensor, that a user has actuated a product advancement device to cause a dispensing mechanism in a dispenser to rotate to dispense consumable product to the user; and communicating, by a data processing device to a remote device, data describing the detection. Other embodiments of this aspect include corresponding systems and apparatus.

Particular embodiments of the subject matter described in this specification can be implemented so as to realize one or more of the following advantages. For example, for sanitary and no-touch dispensers (e.g., dispensers for which the user's primary means to retrieve consumable product does not involve touching the dispenser), information that the user had to use the a manual feed device (e.g., through contacting the dispenser) to retrieve product from the dispenser can provide an indication to a service attendant that the dispenser is malfunctioning or the product is not to specification, as under normal operation the user would not have to use the manual feed device. This allows the attendant to quickly service the dispenser to address any problems or malfunctions, which provides a better user experience, less down time (e.g., poor or no operation periods) for the dispenser, and provides an indication to the service attendant as to the nature of the problem or malfunction.

The details of one or more implementations of the subject matter described in this specification are set forth in the accompanying drawings and the description below. Other features, aspects, and advantages of the subject matter will become apparent from the description, the drawings, and the claims.

Figure 1:
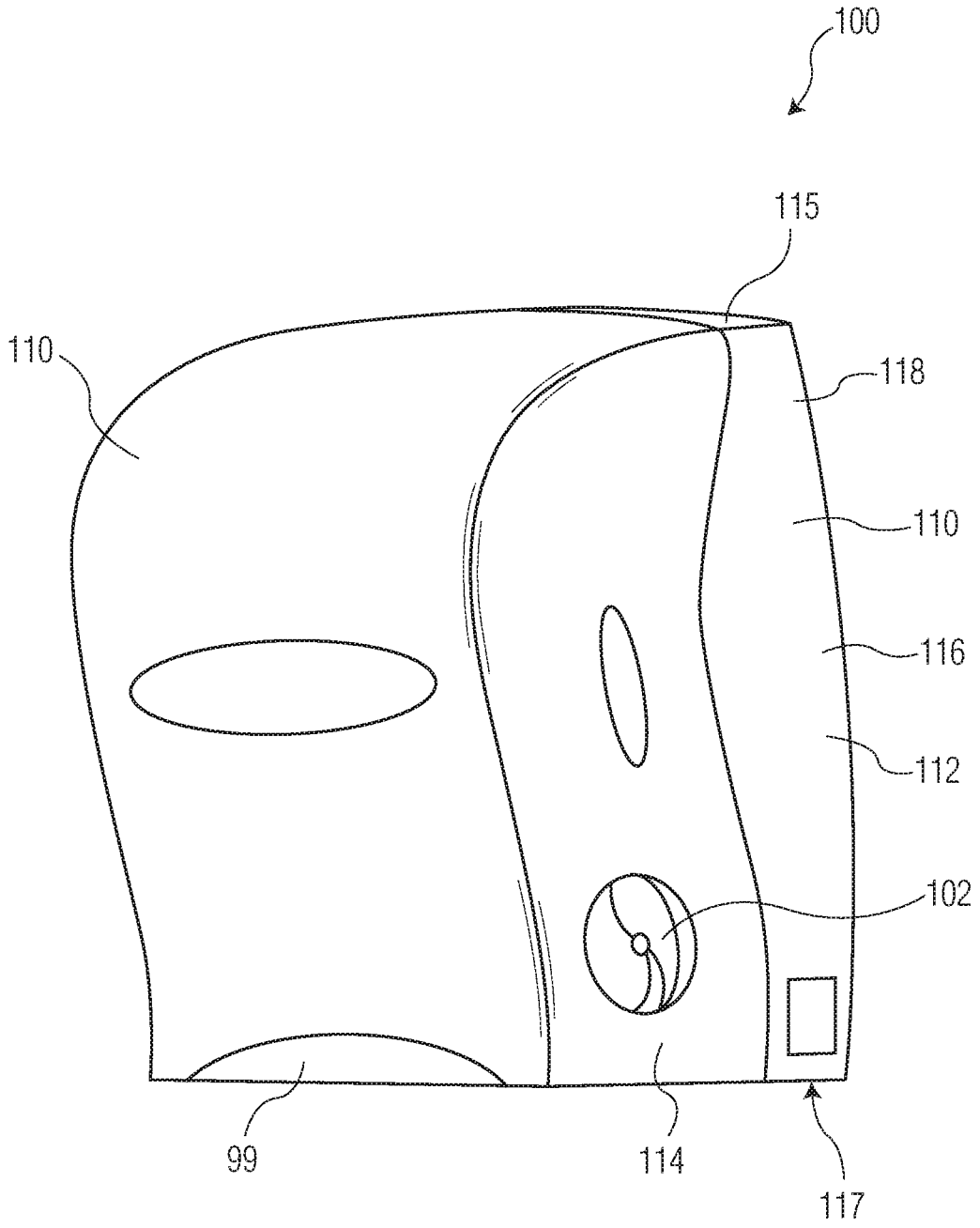
FIG. 1 is a perspective representation of an example dispenser.

Repeat use of reference characters in the present specification and drawings is intended to represent the same or analogous features or elements of the disclosure.

DETAILED DESCRIPTION OF THE DISCLOSURE

The present disclosure relates to determining potential dispenser malfunctions in, for example, "sanitary" or "no-touch" (e.g., manual feed) dispensers in which sheets of consumable product are dispensed by a user pulling an exposed tail of sheet. Thus, for such dispensers, in normal operation the user does not have to touch the dispenser, but rather only the sheet to-be-used.

If sheet does not fully dispense, is prematurely torn (e.g., tabbing) or causes a jam such that the user may have difficulty pulling the sheet off the roll or otherwise accessing an exposed portion of the sheet to complete the dispense process, a product advancement device on the dispenser, e.g., a wheel/knob, lever or push bar, allows the user to manually rotate the dispensing mechanism inside the dispenser, which draws sheets off the roll for access to the user to pull. As such, use of the product advancement device may indicate a malfunction with the dispenser or non-conformance of the consumable product, e.g., the consumable product is not within its manufacturing specification resulting in, for example, low strength and premature tearing. In either case, this information can be used to quickly identify problems with the dispenser and provided to a service attendant to expeditiously remedy the problem.

To this end, the dispenser includes a product advancement sensor that senses when the product advancement device has been used, and the dispenser includes a communication device to send an alert or message to, for example, a service attendant of the product advancement device's use (e.g., to investigate the potential issue). A dispenser with this functionality is described in more detail below with reference to FIG. 1, which is a perspective representation of an example dispenser 100.

The dispenser 100 can be, for example, a hand towel dispenser, bath or facial tissue dispenser, wiper dispenser, or the like. The dispenser 100, more generally, is a device that holds consumable product and dispenses the consumable product in response to a stimulus, e.g., a user or environmental stimulus such as a user pulling on an exposed portion (e.g., tail) of the consumable product. For example, the dispenser 100 dispenses sheets from a roll of sheets of absorbent material (e.g., the sheets on the roll can be perforated or non-perforated) or from a stack of interlaced sheets as in a folded towel configuration. This type of dispenser 100 generally dispenses consumable hygiene products, which are products intended to promote good hygiene or sanitation such as by cleaning or sanitizing a user and/or a surface.

The dispenser 100 includes a body 110, e.g., a composite, polymeric or metal housing. The body 110 encloses, fully or partially, a product holding area and serves to hold the consumable product and protect the internal components of the dispenser 100. In some implementations, for consumable products such as rolled hand towels or bath tissue, the product holding area can be accessed by rotating a front side 114 of the body 110 away from a back side 112 (e.g., the wall mounted side) by a hinge or the like. The back side 112 may have a rear wall 113, top wall 115, sidewalls 116 and a bottom wall 117.

In some implementations, the dispenser 100 includes a dispensing opening 99 located in the front side 114 or bottom wall 117, or the dispensing opening 99 may be formed by a gap between the front side 114 and the back side 112. The dispensing opening 99 provides a point for the consumable product to exit the dispenser 100 for access by a user.

Figure 2A:
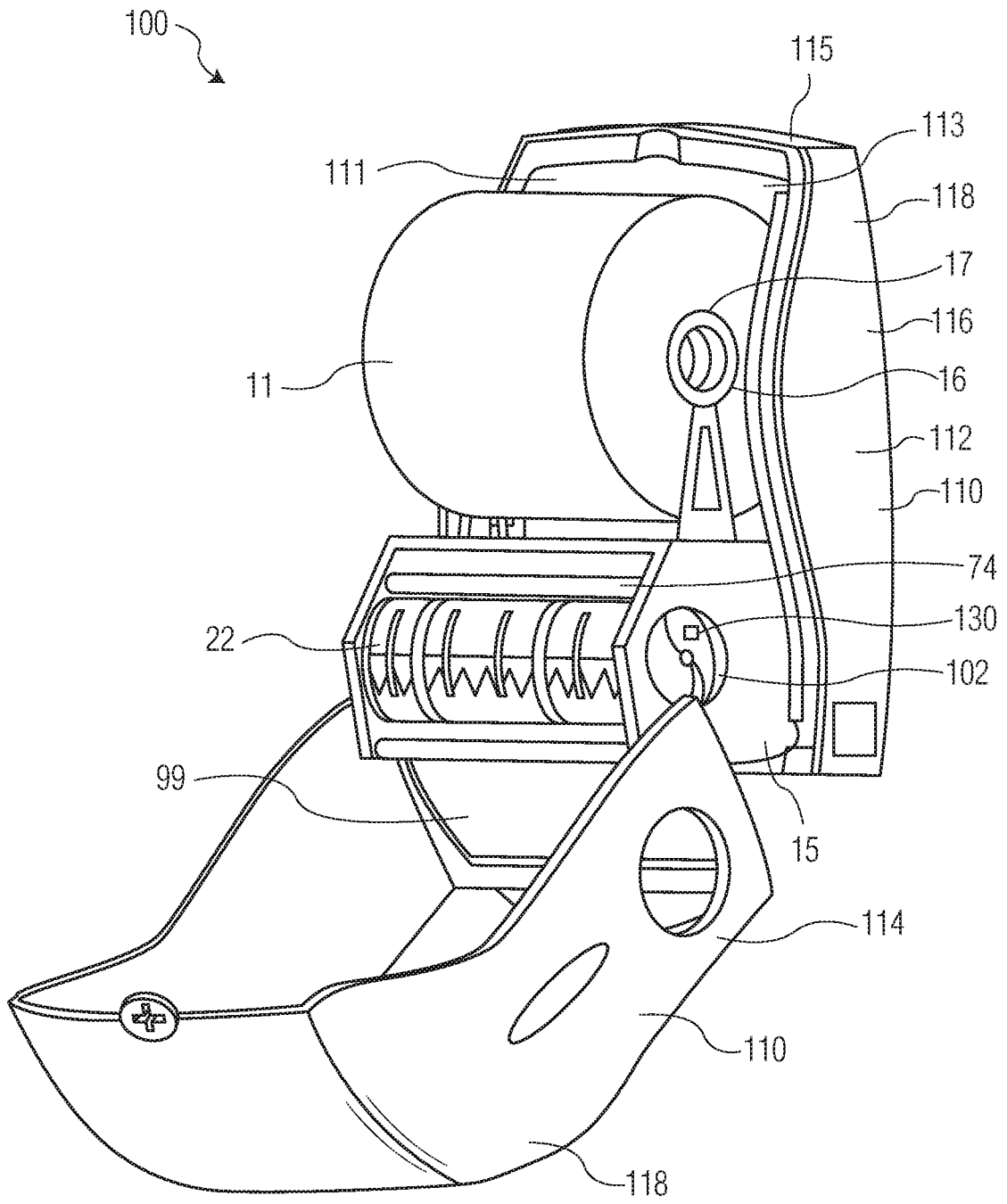
FIG. 2A is a perspective representation of the example dispenser with the front side in an open position.
Figure 2B:
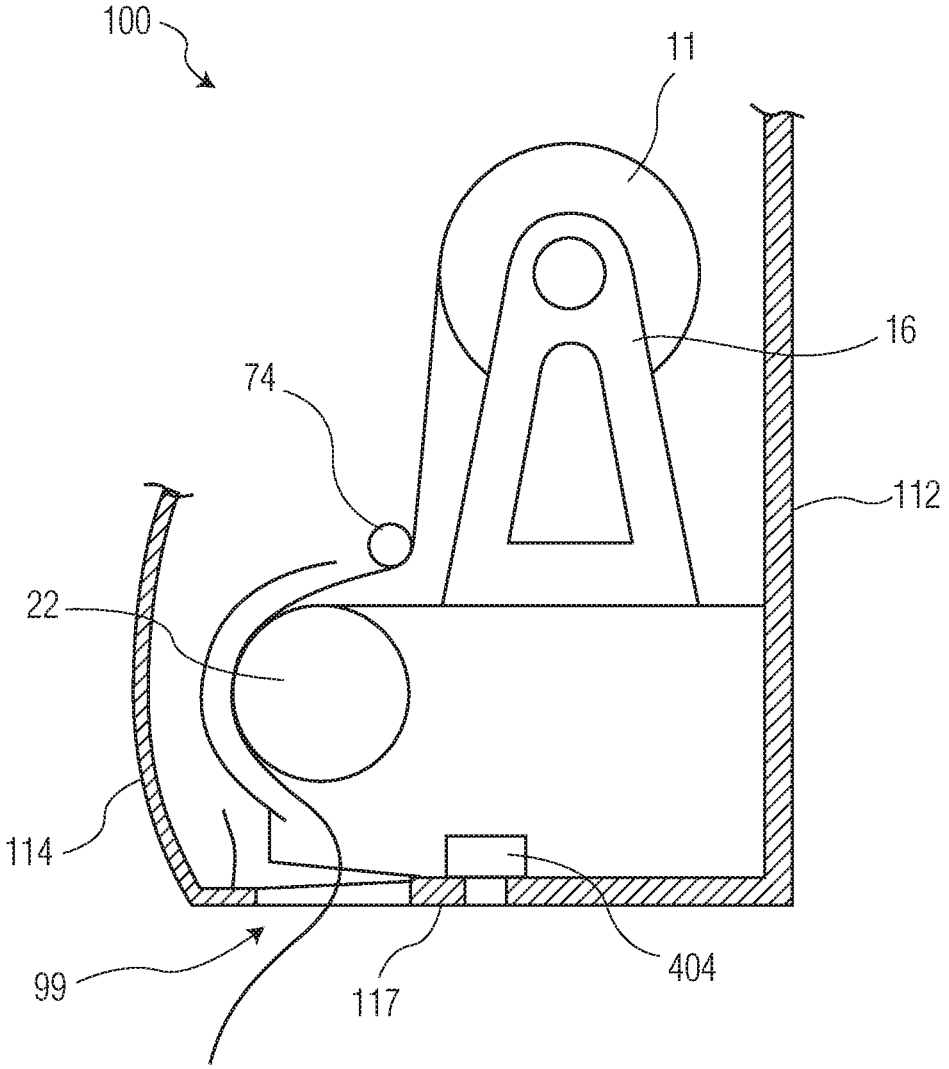
FIG. 2B is a side cutaway representation of the example dispenser.

The dispenser 100 includes a dispensing mechanism 22, as described in more detail below with respect to FIGS. 2A and 2B. FIG. 2A is a perspective representation of the example dispenser 100 with the front side 114 in an open position, and FIG. 2B is a side cutaway representation of the example dispenser 100. The dispensing mechanism 22 is operatively coupled to the consumable product 11 to facilitate a dispensing cycle to dispense a portion (e.g., sheet) of the consumable product 11 in response to, for example, a user pulling on an exposed portion (e.g., tail) of the consumable product 11.

In general, the dispensing mechanism 22 is coupled to the consumable product 11 through a consumable product holder 16, 17 (which in some implementations can be part of the dispensing mechanism 22 and include arms on each side of the roll 11 to support each end of the roll 11). The dispensing mechanism 22 operates to dispense a portion of the consumable product 11 (e.g., dispense a length of roll 105 for use to dry hands), for example, in response to a user pulling on a tail of the sheet 11 exposed through the opening 99.

In some implementations the dispensing mechanism 22 includes a dispensing actuator roller 22 that is rotatably mounted within or proximate the holding area 111. The actuator roller 22 has, for example, a cylindrically-shaped outer peripheral portion and is rotatable in a predetermined direction of rotation. The actuator roller 22 is spaced apart from the consumable product holder 16, 17 to allow the roll 11 to be fed over the actuator roller 22, as shown in FIG. 2B such that when the roller 22 rotates it draws sheets from the roll 11 and pushes a sheet, on a sheet-by-sheet basis, through the opening 99.

In some implementations, the dispensing mechanism 22 includes a guide roller or tensioning device 74. Generally, the guide roller or tensioning device 74 is rotatably mounted and serves to guide sheets from the roll 11 to the actuator roller 22. The guide roller or tensioning device 74 may be positioned next to the actuator roller 22 and can be biased against the actuator roller 22 using a biasing device such as a spring, o-ring bands and the like.

The dispensing mechanism 22 can, in some implementations, include a pivotally mounted cutter blade housed within the actuator roller 22. The cutter blade has, for example, teeth that operate to cut a sheet from the roll 11 when the blade extends during rotation of the roller 22, e.g., by an eccentric cam. The cutter blade, in this example implementation, is pivotally connected to the actuator roller 22 about a pivot point located near an outer portion of the cylindrically-shaped actuator roller 22. With this configuration the cutter blade extends outward from the actuator roller 22 to cut the roll 11 into an individual sheets at a certain point in the rotation of the actuator roller 22.

The dispenser 100 includes a product advancement device 102, e.g., as an emergency manual feed mechanism/device. The product advancement device 102 is coupled to the dispensing mechanism 22 and is accessible external to the body 110. The product advancement device 102 allows a user to manually actuate the dispensing mechanism 22 to dispense a sheet of consumable product 11, for example, when a tail of the sheet is not accessible to the user due to a malfunction. In some implementations the product advancement device 102 is a knob 102.

In some implementations, the product advancement device 102 is releasably coupled to the dispensing mechanism 22 such that the product advancement device 102 will not rotate unless it is manually engaged by the user to the dispensing mechanism 22. For example, the product advancement device 102 can be mounted with a biasing device (not shown) which would require the user to push the product advancement device 102 toward the dispensing mechanism 22 or, in the alternative, to pull the product advancement device 102 away from the dispensing mechanism 22 to engage the product advancement device 102 with the dispensing mechanism 22.

In some implementations, the product advancement device 102 is continuously engaged with the dispensing mechanism 22 so that the product advancement device 102 will rotate with the dispensing mechanism 22 as the dispensing mechanism 22 turns. The product advancement device 102 can be, for example a knob 102 (as described above), or a user-actuated lever or push bar. Regarding the lever or push bar, for example, each is configured to rotate the dispensing mechanism 22 when actuated by a user, and operate, in effect, similar to the knob implementation as described above.

The dispenser 100 includes a product advancement sensor 130 to sense the manual actuation of the dispensing mechanism 22 through use of the product advancement device 102. For example, the product advancement sensor 130 identifies when the user uses the product advancement device 102 to feed out (or try to feed out) a sheet or complete feeding out the remainder of a torn sheet, as opposed to a user pulling the tail of the exposed sheet to cause a sheet dispense during normal operation. As described above, the use of the product advancement device 102 can be a sign that the dispenser 100 is malfunctioning or that the consumable product 11 is not in specification.

In some implementations, the product advancement sensor 130 is a capacitive sensor 130 mounted on or in the product advancement device 102 that sensors when a user's hand is proximate or touching the product advancement device 102 (by sensing a change in the dielectric constant in the area of the product advancement device 102. Alternatively, the product advancement sensor 130 could be an optical sensor 130 (e.g., a photodiode) mounted on or in the product advancement device 102 that sensors when a user's hand is proximate or touching the product advancement device 102 by detecting a change in the light sensed by the sensor 130. In some implementations, the product advancement sensor 130 is a pressure sensor 130 that senses when force is applied to the product advancement device 102, e.g., to actuate the product advancement device 102.

The dispenser 100 includes a data processing device 404 that communicates with the product advancement sensor 130 to determine when it has sensed a use of the product advancement device 102 and, in response to such determination, transmits (e.g., through use of a transceiver) an alert indicating such use/manual actuation of the product advancement device 102. For example, the data processing device 404 transmits the alert to a mobile device/remote device of a service attendant for the dispenser 100 to notify the attendant of the potential issue.

The data processing device 404 can be integral to and resident at the dispenser 100 or remote and separate from the dispenser 100 (e.g., in which case the data processing device 404 and the dispenser 100 could communicate through transceivers or transmitters and/or receivers).

Embodiments

Embodiment 1. A dispenser for dispensing consumable product comprising:

a body comprising a front side and a back side, and a product holding area defined by the front side and the back side, wherein the product holding area is configured to store the consumable product within the dispenser;

a dispensing mechanism operatively coupled to the consumable product, and wherein the dispensing mechanism is configured to facilitate a dispensing cycle to dispense a portion of the consumable product in response to a user pulling on an exposed portion of the consumable product;

a product advancement device coupled to the dispensing mechanism and accessible external to the body, and wherein the product advancement device is configured to allow a user to manually actuate the dispensing mechanism;

a product advancement sensor configured to sense the manual actuation; and a data processing device configured to communicate with the product advancement sensor and transmit an alert indicating the manual actuation.

Embodiment 2. The dispenser of embodiment 1, wherein the dispensing mechanism comprises a dispensing actuator roller.

Embodiment 3. The dispenser of embodiment 2, wherein manually actuate the dispensing mechanism comprises rotating the dispensing actuator roller.

Embodiment 4. The dispenser of embodiments 2 or 3, wherein the dispensing actuator roller comprises a cutter blade.

Embodiment 5. The dispenser of any preceding embodiment, wherein the product advancement device comprises a user-actuated lever.

Embodiment 6. The dispenser of any of embodiments 1-4, wherein the product advancement device comprises a user-actuated push bar.

Embodiment 7. The dispenser of any of embodiments 1-4, wherein the product advancement device comprises a user-actuated, rotatable knob.

Embodiment 8. The dispenser of any preceding embodiment, wherein the data processing device comprises a transceiver.

Embodiment 9. The any preceding embodiment, wherein the product advancement sensor comprises a capacitive sensor.

Embodiment 10. The dispenser of any of embodiments 1-8, wherein the product advancement sensor comprises an optical sensor.

Embodiment 11. The dispenser of embodiment 10, wherein the optical sensor comprises a photodiode.

Embodiment 12. The dispenser of any of embodiments 1-8, wherein the product advancement sensor comprises a pressure sensor.

Embodiment 13. The dispenser of any preceding embodiment, wherein the consumable product is hygienic product.

Embodiment 14. A method comprising:

detecting, by a product advancement sensor, that a user has actuated a product advancement device to cause a dispensing mechanism in a dispenser to rotate to dispense consumable product to the user; and communicating, by a data processing device to a remote device, data describing the detection.

Embodiment 15. The method of embodiment 14, wherein the dispensing mechanism comprises a dispensing actuator roller.

Embodiment 16. The method of embodiment 15, wherein the dispensing actuator roller comprises a cutter blade.

Embodiment 17. The method of any of embodiments 14 or 16, wherein the product advancement device comprises a user-actuated lever.

Embodiment 18. The method of embodiment 14 or 16, wherein the product advancement device comprises a user-actuated push bar.

Embodiment 19. The method of embodiment 14 or 16, wherein the product advancement sensor comprises an optical sensor.

Embodiment 20. The method of embodiment 14 or 16, wherein the product advancement device comprises a user-actuated, rotatable knob.

Portions of implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus.

A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The operations described in this specification can be implemented as operations performed by a data processing apparatus on data stored on one or more computer-readable storage devices or received from other sources.

The term "data processing device" encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Devices suitable for storing computer program instructions and data include all forms of non-volatile memory, media and memory devices, including by way of example semiconductor memory devices, e.g., EPROM, EEPROM, and flash memory devices; magnetic disks. The processor and the memory can be supplemented by, or incorporated in, special purpose logic circuitry.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

This written description does not limit the invention to the precise terms set forth. Thus, while the invention has been described in detail with reference to the examples set forth above, those of ordinary skill in the art may affect alterations, modifications and variations to the examples without departing from the scope of the invention.

What is claimed is:

1. A dispenser for dispensing consumable product comprising:

a body comprising a front side and a back side, and a product holding area defined by the front side and the back side, wherein the product holding area is configured to store the consumable product within the dispenser;

a dispensing mechanism operatively coupled to the consumable product, and wherein the dispensing mechanism is configured to facilitate a dispensing cycle to dispense a portion of the consumable product in response to a user pulling on an exposed portion of the consumable product;

a product advancement device coupled to the dispensing mechanism and accessible external to the body, and wherein the product advancement device is configured to allow a user to manually actuate the dispensing mechanism;

a product advancement sensor configured to sense the manual actuation; and a data processing device configured to communicate with the product advancement sensor and transmit an alert indicating the manual actuation.

2. The dispenser of claim 1, wherein the dispensing mechanism comprises a dispensing actuator roller.

3. The dispenser of claim 2, wherein manually actuate the dispensing mechanism comprises rotating the dispensing actuator roller.

4. The dispenser of claim 2, wherein the dispensing actuator roller comprises a cutter blade.

5. The dispenser of claim 1, wherein the product advancement device comprises a user-actuated lever.

6. The dispenser of claim 1, wherein the product advancement device comprises a user-actuated push bar.

7. The dispenser of claim 1, wherein the product advancement device comprises a user-actuated, rotatable knob.

8. The dispenser of claim 1, wherein the data processing device comprises a transceiver.

9. The dispenser of claim 1, wherein the product advancement sensor comprises a capacitive sensor.

10. The dispenser of claim 1, wherein the product advancement sensor comprises an optical sensor.

11. The dispenser of claim 10, wherein the optical sensor comprises a photodiode.

12. The dispenser of claim 1, wherein the product advancement sensor comprises a pressure sensor.

13. The dispenser of claim 1, wherein the consumable product is hygienic product.

* * * * *